United States Patent [19]

Wilson

[11] Patent Number: 4,905,490

[45] Date of Patent: Mar. 6, 1990

[54] LOCK COMBINATION DECODER

[76] Inventor: Glenn E. Wilson, 24 Spring St., Endicott, N.Y. 13760

[21] Appl. No.: 236,236

[22] Filed: Aug. 25, 1988

[51] Int. Cl.[4] ..... E05B 17/00

[52] U.S. Cl. ..... 70/442; 70/446; 70/313; 364/130

[58] Field of Search ..... 70/313, 442, 446; 364/130, 174, 400

[56] References Cited

U.S. PATENT DOCUMENTS

| | | | |
|---|---|---|---|
| 2,974,517 | 3/1961 | Jacobs | 70/442 |
| 4,056,956 | 11/1977 | Gilliam | 70/446 |
| 4,319,223 | 3/1982 | Caruso | 70/313 X |
| 4,377,847 | 3/1983 | Daniel et al. | 364/130 X |
| 4,433,563 | 2/1984 | Wilson | 70/446 |
| 4,769,583 | 9/1988 | Goor | 364/174 X |
| 4,777,603 | 10/1988 | Woodman et al. | 364/130 X |
| 4,803,860 | 2/1989 | Moore | 70/442 X |

OTHER PUBLICATIONS

Costley, Brian, "ITL-1000:Opening Safes the Old-Fashioned Way-It Dials Them", Locksmith Ledger, Jun. 1988.

Gilliam, David, "Safe Lock Manipulation Simplified", New York School of Locksmithing, 1975.

Vaughan Armstrong, "Manipulation? Its's a Breeze", Locksmith Ledger, Mar. 1988.

*Primary Examiner*—Gary L. Smith
*Assistant Examiner*—Suzanne L. Dino
*Attorney, Agent, or Firm*—Wall and Roehrig

[57] ABSTRACT

Apparatus for determining the opening combination of a safe lock includes a servo motor, a molded dial gripper that fits over the hub of the combination lock dial, and a high resolution rotary, encoder, preferably one with a resolution of 1000 PPR. The rotary encoder has a resolution of 0.09 degrees of rotation using quadrature, which permits the dial to be rotated accurately to within 1/10 of a digit. A programmable logic and control circuit can rotate the dial for automatic implementation of a manipulation technique. This permits the safe combination to be found in a rather short period of time, typically less than one hour.

9 Claims, 3 Drawing Sheets

LOCK COMBINATION DECODER

BACKGROUND OF THE INVENTION

This invention relates to locksmithing equipment, and is more particularly directed to a device for automatically finding the opening combination for the combination lock of a secure cabinet, safe, or vault. The invention is more particularly directed to apparatus that can employ a "manipulation" technique, i.e., by sensing the dial position of so-called contact points, and automatically dialing to the contact points to determine the digits or numbers, and the proper sequence, of the opening combination.

It sometimes occurs that the combination to a safe, cabinet, or vault is forgotten or lost, or is simply not available and not recorded. In such cases, it is up to the skill of the individual locksmith to open the safe. Even under ideal circumstances, where the locksmith is familiar with the safes and locks of the same manufacturer, and where one or more numbers of the combination may be known, it is still a difficult, time consuming, and frustrating task to decode the opening combination. In some cases, particularly where the workings of the lock mechanism are old and not understood, the locksmith may drill into the lock assembly to permit visual manipulation of the rotor, wheels, or tumblers and the associated release mechanism of the lock. Of course, where drilling into the safe or vault is required, it is usually necessary to replace the lock, and, in any event, the drill holes must be welded shut before the safe can be used again. Invariably, finding the opening combination of a safe or vault is an extremely difficult and frustrating activity, even for the most experienced locksmiths.

The so-called manipulation technique is a manual, nondestructive procedure, in which, without the use of sophisticated tools or equipment, the locksmith senses, either audibly or by feel, the so-called "contact" points. The position of the contact points has to be determined very accurately, that is, to within about the nearest tenth of a digit or number on the dial. The exact reading of the contact point is recorded where it is reached from each of a number of starting positions around the dial. These readings are charted and low or high spots are scrutinized to yield the opening number for one of the several rotors or wheels of the lock. Then a test is run to see whether it is the number one, two, or three wheel that indicated. This procedure is repeated until the opening number for each of the wheels is learned.

Manipulation is an involved, tedious procedure, and it requires a high degree of skill and considerable background experience. The procedure can be expected to take one full day or more for a skilled locksmith working without interruption.

This technique is well-known in the locksmithing trade. A description of one version of a manipulation technique is contained in David Gilliam, "*Safe Lock Manipulation Simplified,*" New York School of Locksmithing, 1975.

While no special equipment is required, many locksmiths use a stethoscope or other listening device to listen for the contact points. Special scales, magnifiers, and special lighting are sometimes employed to help the locksmith find the location of contact points to within a small fraction of the spacing between successive dial digits.

There has been proposed a combination of an electro-optical dial position sensor and a sensitive microphone for indicating the position of contact points, specifically to assist the locksmith in manually manipulating the safe lock. One such manipulation aid is described in Armstrong, "Manipulation? It's A Breeze!", *Locksmith Ledger*, March 1988. Even with this type of aid, there is still room for human error, and it still requires considerable time for a highly experienced locksmith to open the safe.

Because of difficulties in accurately sensing the contact points, the manipulation technique does not work every time on all types of safes and locks. Extreme care must be exercised in rotating the dial at a steady rate and with even hand pressure. Thus, it is difficult to manipulate old locks, or locks with loose or sticky dials. It is also extremely difficult and time consuming to open a so-called manipulation-proof lock, which incorporates some feature for defeating attempts to find the contact points. While even a manipulation proof lock can be subjected successfully to a manipulation technique, additional steps are required, and consequently the time and difficulty in opening this type of lock are several times that required for other locks.

In my previous U.S. Pat. No. 4,433,563, I disclosed a safe opening apparatus which would automatically, and unattended, decode a safe lock combination. This device, however, did not employ manipulation, but rather worked all possible safe combinations until the safe lock opened. There were three innovative processes employed by this device. First, it did not try "illegal" combinations. Secondly, it skipped every two numbers before trying the combination. Third, it adjusted only the necessary tumblers when dialing new combinations. The device included means to detect when the opening combination had been reached. However, the device required an amount of time related to the exponential of the number of tumblers or wheels, as it could not determine each number of the opening combination independently. Inherently, the device had to solve all of the numbers at the same time. While this device did not require the continued presence of the locksmith, typically it still required several days of continuous running to find the lost combination.

The previous device also was not sensitive enough to sense degrees of rotation less than 1/100 of a dial rotation, and would not lend itself easily to modification to make it suitable for use in automatic safe manipulation.

OBJECTS AND SUMMARY OF THE INVENTION

Accordingly, it is an object of this invention to provide a locksmithing technique which overcomes the drawbacks of the prior art.

It is another object of this invention to provide a nondestructive, automatic, and rapid technique for opening a combination lock whose combination is unknown.

It is a more specific object of this invention to provide locksmithing apparatus which is straightforward to set up and operate, and which will automatically find the opening combination for the lock of a safe, vault, or other secure container.

It is another object of this invention to provide apparatus which accurately indicates the combination lock dial position to within 1/10 of a digit as the dial is being rotated.

It is still another object of this invention to provide apparatus which can open most combination lock safes, vaults, or security containers in less than one hour.

It is a further object of this invention to provide safe combination decoder apparatus which can decode the combination of so-called manipulation-proof combination locks.

According to an aspect of this invention, a safe lock decoder is employed for finding the opening combination for the lock of a vault, safe, or other secure container. The combination lock is of the type that includes a rotatable dial containing a predetermined number of equally spaced integers, typically "00" through "99". A driver is turned by the shaft on which the dial is mounted, and turns a number of rotors or discs, each of which has a cutout or gate located along its periphery. An opening lever has a fence which rides against the periphery of the wheels, and which draws the locking bolt to an open position when the fence aligns with all of the gates. All of the wheels cannot have identical diameters, and thus, the fence will always ride on the wheel which has the largest radius at the point in contact with the fence. Descent of the fence into any gate or combination of aligned gates, will allow the nose of the lever to descend deeper into the notch of the driver until all of the gates are aligned with the fence. This happens when the opening combination has been dialed. Until all gates are aligned, the driver will at some point during rotation make an audible contact with the nose of the lever, and provide a detectable contact point. The location of the contact point depends on the setting of the opening combination.

The decoder apparatus has a frame which is securable in a fixed position relative to the lock. This can include a plate or flange which can be banded or strapped to the safe itself to hold the decoder steady. A dial gripper is rotatably journalled in the frame, and has a cylindrical socket that fits snugly over the hub of the dial for rotating the dial. A dc servo motor has a stator portion that is mounted onto the frame and a rotor shaft that is coupled to the dial gripper. A rotary encoder is coupled to the servo motor to indicate the position of the dial to within an accuracy of a fractional part of the span between successive integers on the dial, typically to 1/10 of that span. The rotary encoder provides a position feedback output and a velocity feedback output to indicate the rotary position and rotary speed of the dial. A highly sensitive microphone or similar sound transducer is mounted on the safe so that it is in audible contact with the lock and this provides an indication when the contact point is reached. A suitably programmed processor and control circuit has inputs to receive the position feedback output and the velocity feedback output, as well as the indication from the audible transducer. This controls a motor drive output for rotating the servo motor rotor, and hence the dial, to positions chosen by the processor and control circuit. A storage memory records the dial position at which the contact point is reached for each wheel of the lock for a plurality of starting positions around the dial. The processor and control circuit can be programmed with a suitable manipulation algorithm to operate the servo motor and decode the opening combination.

Preferably, the encoder is a two-phase rotary encoder with a resolution of substantially one thousand parts per rotation. The apparatus employs the velocity output and position output to rotate the servo motor and dial quickly to the vicinity of the contact points, and then rotate the dial slowly until the contact point is reached. The dial gripper can preferably be a molded cup of a plastic synthetic resin. In order to open a manipulation-proof lock, a second motor controlled by the processor and control circuit means actuates a key or other device on the lock, which is often a flat knob, called a butterfly on the dial hub.

The above and many other objects, features, and advantages of this invention will be more fully understood from the ensuing description of a preferred embodiment, which should be read in connection with the accompanying Drawing.

DETAILED DESCRIPTION OF THE PREFERRED EMBODIMENT

Figure 1:
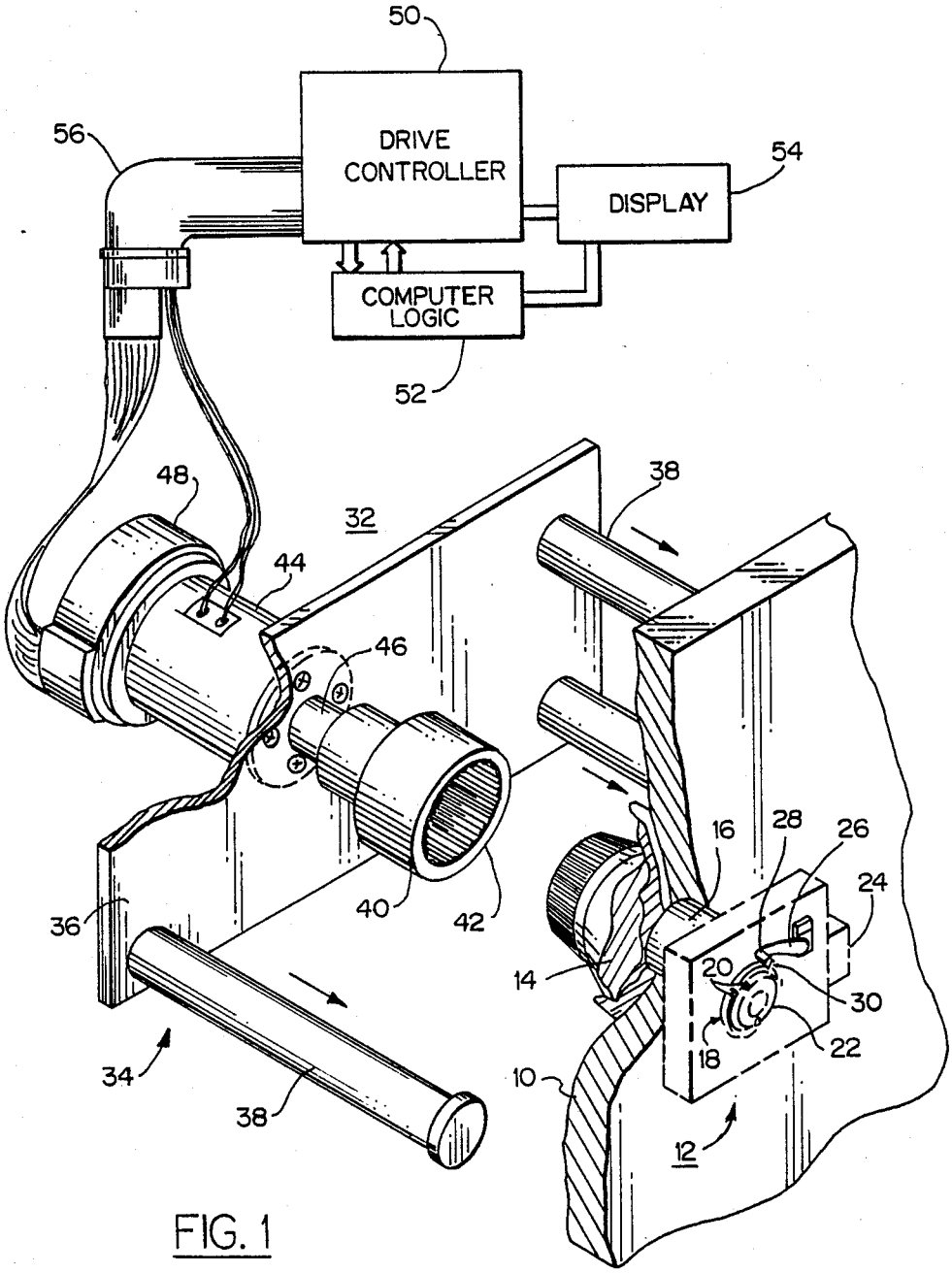
FIG. 1 is a perspective view of a safe combination decoder according to one embodiment of this invention.

With reference to the Drawing, and initially to FIG. 1, a portion of a safe 10 is shown containing a combination lock 12 with a rotary dial 14 that typically contains one-hundred evenly spaced digits. A shaft 16 penetrates the safe and is rotated by the dial 14. Inside the lock 12 are three or more rotors or wheels 18, each of which has a gate 20 in the form of a square or rectangular cutout. A driver 22 is mounted on the shaft 16 behind the wheels 18, and serves to rotate the wheels. A bolt 24 is moved between open and closed positions by means of a lever 26. The free end of the lever has a fence 28 which rides on the periphery of the wheels 18 and drops into the gates 20 when the three or more wheels 18 have their gates aligned. In such case, a nose 30 of the lever drops into a corresponding notch 31 on the driver 22 so that further rotation will pull back the bolt 24. Then the safe can be opened. Between the wheels are a number of flies or cogs to permit the wheels to turn in sequence. A reference mark or crow's foot is inscribed on the safe 10 adjacent the dial 14.

The construction and function of dial type combination locks is well known in the art, but if further description and explanation is desired, the same can be found in my earlier U.S. Pat. No. 4,433,563, the contents of which are incorporated herein by reference.

While most safes have three rotors or wheels 18, and thus require a combination of three numbers, it is not uncommon for a safe to have a lock with four or five wheels, thus requiring a correspondingly longer sequence of numbers in its opening combination.

As further shown in FIG. 1, a safe lock decoder mechanism 32 that embodies my invention has a base or frame 34 in the form of a flange or plate 36 supported on a number of legs or mounts 38 which can be fitted against the safe 10. The frame can be strapped to the safe with straps or bands (not shown) to hold it securely while the safe is being manipulated by the decoder mechanism 32.

A gripper 40, preferably formed as a cup of molded plastic synthetic resin, has a generally cylindrical receptacle 42 which fits over the hub or knob of the dial 14. A dc servo motor 44 has its casing and stator affixed to the plate 36 and has a rotor shaft 46 penetrating the plate 36. The dial gripper 40 is secured onto the shaft 46, so that the gripper is rotatably journalled with respect to the frame 34.

A rotary encoder or indexer 48 is mounted on the motor 44 and provides a digital output which corresponds to an extremely high resolution reading of the rotary position of the shaft 46, gripper 40 and dial 14. Extremely high resolution is desirable in finding the opening combination digits from the detected position of contact points, as described in greater detail below. In a preferred embodiment, the rotary encoder 48 has a resolution of one thousand parts per rotation, i.e., increments of 1/10 of a digit for a one-hundred digit dial.

A driver controller circuit 50, shown here very schematically, is coupled by a multi-conductor cable 56 to the motor 44 and encoder 48 and is also coupled to a computer logic or processor 52 as well as to a display 54 which can indicate the position of contact points and combination digits. The cable 56 carries power and data conductors for the motor 44 and encoder 48.

Figure 2:
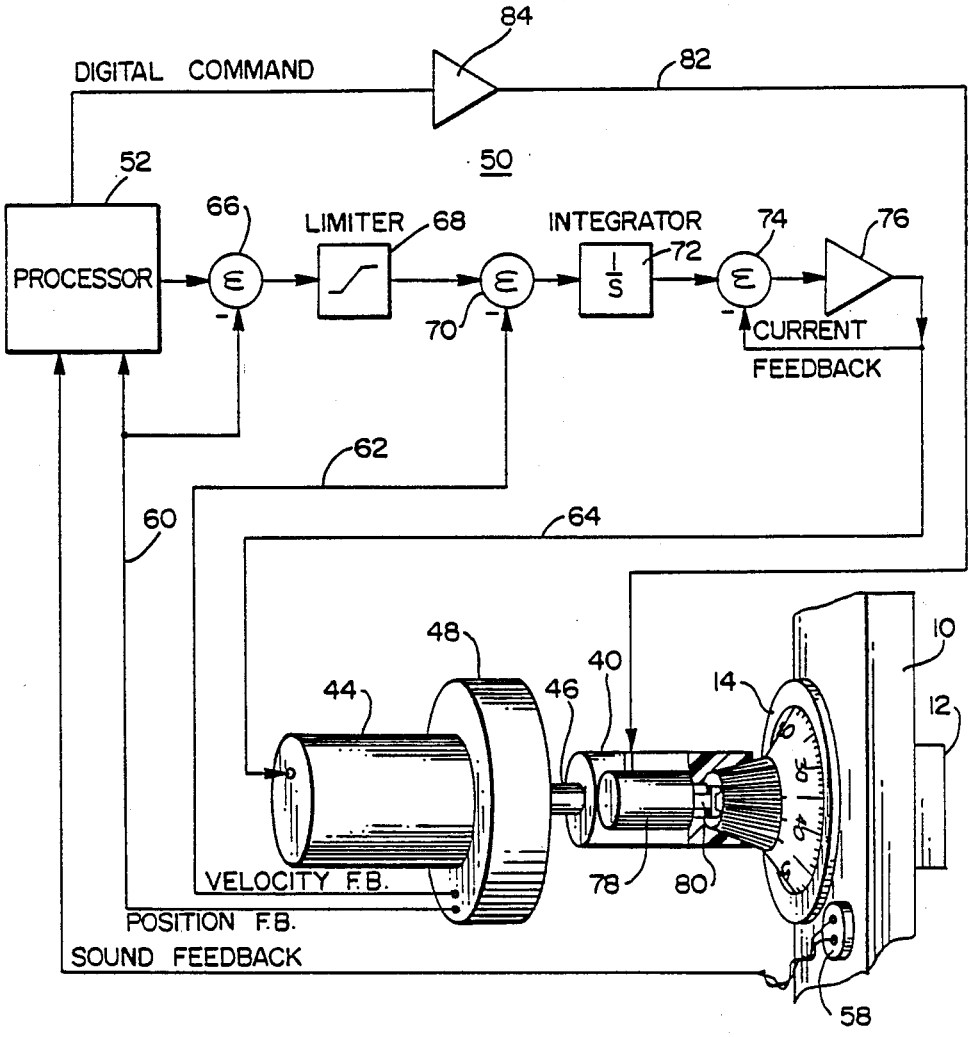
FIG. 2 is a schematic view for explaining the function and operation of the safe lock decoder according to this invention.

As shown in FIG. 2, a sound transducer 58, such as a sensitive microphone pick-up, is taped or held magnetically on the safe 10 and provides an electrical indication whenever the contact points are reached during rotation of the dial. The processor 52 can include means to disregard the output from the transducer 58 except when the dial 14 is in the vicinity of the contact points, so as to avoid false readings. The encoder 48 provides a position feedback signal and a velocity feedback signal along respective feedback channels 60 and 62, while the driver controller circuit 50 supplies current to the motor over motor drive conductors 64, illustrated schematically in FIG. 2. In the decoder mechanism shown in FIG. 2, the position of the motor 44 and encoder 48 are reversed, to illustrate that the relative positions of these elements is not critical. Within the driver controller circuit 50, a subtracter circuit 66 follows the processor 52 and receives the position feedback from the channel 60. The output of the subtracter is supplied through a limiter 68 to another subtracter 70 which has an input connected to the channel 62 to receive the velocity feedback signal. The output of this subtracter 70 is supplied through an integrator 72 which allows sufficient current to overcome motor friction while the motor is turning slowly, and thence to a subtracter 74 whose output is fed through a drive amplifier 76 to the dc servo motor 44. Current feedback from the amplifier 76 is supplied to a 20 subtraction input of the subtracter 74.

This arrangement permits fast rotation of the dial, i.e., on the order of one revolution per second, at first, and then linearly slower rotation within one-quarter turn of the requested position while setting the tumblers, and ultimately the target area which contains the contact points.

For use with so-called manipulation proof locks, a second motor 78 and actuator 80 are carried within the dial gripper 40. In this embodiment, the actuator 80 comprises means to turn a butterfly or other key (not shown) located at the center of the hub of the dial 14. In certain older safes and in other possible arrangements, there is an additional lever to one side of the dial, and a motor and actuator can be provided to apply pressure to that lever during manipulation.

For operating the second motor 78, a motor drive channel 82 emanates from the processor and includes a drive amplifier 84 supplying drive current, as required, to the motor 78.

A suitable manipulation algorithm can be programed into the computer logic or processor 52. As mentioned before, safe lock manipulation is a technique well-known in the locksmithing trade, but has always been carried out manually. It is nonetheless difficult to perform because of the high level of skill and extreme sensitivity required. Moreover, it takes considerable time and experience to manually manipulate a three-number lock.

Figure 3:
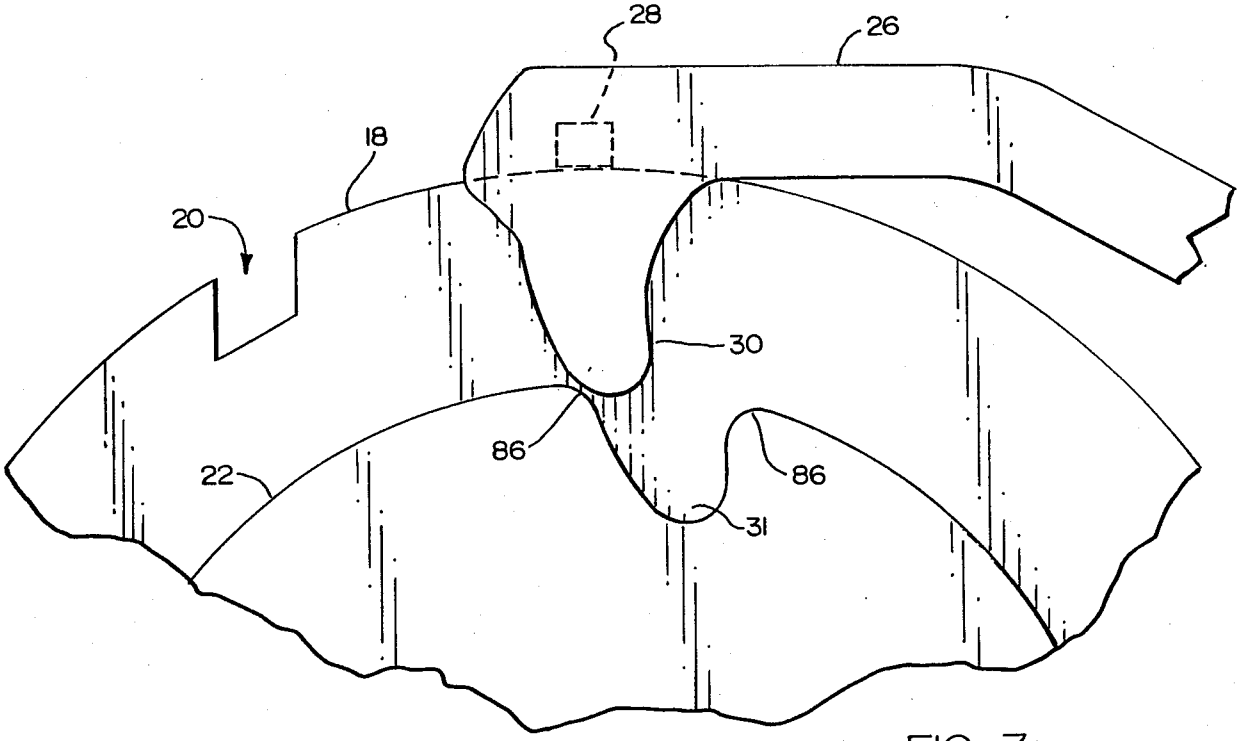
FIG. 3 is a partial elevation of part of the safe lock mechanism, for explaining the operation of this invention.

The manipulation algorithm can take the form of the technique described by David Gilliam in *Safe Lock Manipulation Simplified*, New York School of Locksmithing, 1975. Referring also now to FIG. 3, the object of this technique is basically to find the positions of the gates 20 on the three or more wheels 18, based on the fact that when the gate of one of the wheels 18 comes under the lever fence 28, the nose 30 of the lever will drop deeper into the driver notch 31 and change the position of the contact points 86 slightly. By keeping track of the readings of contact point locations for various starting locations around the dial 14, it is possible to find the gate positions for all the wheels 18 and then to open the lock 12.

Of course, unless the locksmith is completely familiar with the model and manufacture of the lock on the safe in question, the first step is to rotate the dial to determine the number of wheels. The next step is to find the contact area. To do this, the dial 14 is rotated slowly back and forth until contact is made between the nose 30 of the lever 26 and the notch of the driver 22. Typically there are both left and right contact points 86, although the lock can be opened by using either of the contact points independently.

To determine the first opening number, the dials in all of the wheels are rotated from spaced starting positions, e.g., positions separated by two and one-half integers. This yields twenty-five readings. When the largest of the three wheels has its gate 20 more-or-less aligned with the notch 31 in the driver 22, the contact point 86 will move noticeably, perhaps by as much as one-half of a digit, but often by considerably less. The contact point positions for the various start positions are recorded electronically, and the algorithm scans this record to find generally high or low areas. Then the position of the contact point or points is observed electronically for single digit starting points over about a ten digit span covering the high or low area. The opening number will appear as a sharp rise or drop. For example, a sharp drop may appear at digit number 36, so that the combination will be 36-XX-YY, or XX-36-YY, or XX-YY-36.

Then a test is run to determine which wheel it was that indicated first. A simple algorithm uses true and test numbers, where the test number is spaced ten digits from the true number, i.e., 26 or 46. The span between right and left contact points will be higher for one of the three wheel tests, which will indicate whether it is the number one, number two, or number three wheel that has the known number. For example, if the test shows that the first-indicating wheel is wheel number two, then the combination will be XX-36-YY.

After that, the next step is to find the second number to indicate. This, of course, depends upon which wheel had indicated first. To find this the dial is cleared and then turned to the known number for that wheel, and then back to the contact area to find right and left contact digits. This is tried at two-and-one-half intervals around the dial to find high and low areas. The contact area readings are stored electronically for each of the starting points, and then a ten digit area in the vicinity of the high and low areas is tried, one digit at a time, to yield the second number. For example, the second number can be 24. At that point, the combination can be XX-36-24 or 24-36-YY.

Test and true numbers are used to find which wheel it was that indicated second of the two remaining wheels, e.g., wheels numbers one and three. Based on the span between left and right contact points, it can be determined whether the number one or number three wheel is what was indicated. For example, this test can show that the second wheel to indicate was wheel number one, so the combination known to this point would be 24-36-YY.

For a three wheel safe lock, the third wheel is selected by process of elimination.

The remaining number for the last wheel can be found by dialing to clear and then dialing to the known numbers for wheels one and two, and then to each two-and-one-half digit increment around the dial. The dial is then advanced to the contact are to find left and right contact points, which are electrically recorded. The third digit is found in a manner quite similar to that of finding the first and second digits. The third digit will then be indicated by a sharp drop in the position of the contact points, which can occur, for example, at the digit 48. Because it is known that this is for the third wheel, the combination sequence in this example would be 24-36-48 to open.

With the above procedure, as generally described, and with the equipment of the described embodiment, a three-digit safe combination can be found typically in about forty minutes, and usually in under one hour.

If the safe 10 is of the so-called manipulation-proof type, its butterfly, key, or similar feature, is turned by actuating the second motor 78 when the dial 14 is in the neighborhood of the contact area. This permits the fence 28 and nose 30 of the lever 26 to descend into contact with the wheels 18 and the driver 22.

An additional actuator (not shown) can be used in place of the second motor 78 and actuator 80, for opening older safes of the "direct fence" type. The additional actuator would be so disposed as to operate a lever to one side of the dial.

A "direct fence" is a fence that is either incorporated in the bolt as an integral part, or is connected directly to the bolt. When a safe has a direct-fence lock, there is no spring or gravity to urge the fence against the wheels. Also in many of these, the lever does not have a nose to fall into the driver. The lock can be simply activated when all the gates are aligned in the path of the fence, allowing the bolt's direct fence to enter the wheels' gates. In this case, there are no "contact points" so the manipulation technique as described above could not be applied directly. However, the principles described in my prior U.S. Pat. No. 4,433,563 could be employed with the apparatus described above.

As an alternative, rather than applying a manipulation technique, the apparatus as described above can open the safe 10 by working through each possible combination from 00-00-00 to 99-99-99, in an established sequence, avoiding any known invalid sequences. Another alternative method could be that described in my previous U.S. Pat. No. 4,433,563. This process should take less than one full day of continuous operation, but in any event could be carried out unattended.

In the techniques described above, a modem or other suitable communication device can be connected to the processor 52 for alerting the locksmith by telephone when the combination has been found, or alternatively, for transmitting the combination to the locksmith.

Preferably, a set of interchangeable grippers 40 is included as a kit with the safe lock decoder mechanism. For example, a set of four such grippers should be sufficient to fit the safe dials of most U.S. manufacturers.

With the decoder mechanism 32 described hereinabove, dial rotation is carried out much more consistently than is possible even with the most careful manual rotation. Also, because of the snug fitting of the dial hub into the gripper 40, sticking dials or loose dials on the safe can be easily accommodated without adversely affecting the decoding operation. Moreover, as this technique does not rely on visually reading the digits on the dial, it can be employed for opening safes on which the dial is cracked, partly broken, or in which the numbers are partly worn down. This also eliminates the possibility of human error in reading or setting of the dial, or in reading the positions of contact points.

While this invention has been described in detail with reference to a certain preferred embodiment, it should be understood that the invention is not limited to that embodiment. Rather, many modifications and variations would present themselves to those skilled in the art without departing from the scope and spirit of this invention, as defined in the appended claims.

What is claimed is:

1. Safe lock decoder apparatus for finding the opening combination for a combination lock of the type that includes a rotatable dial containing a predetermined number of equally spaced integers; a driver that is rotatable with said dial; a locking bolt; a plurality of wheels rotatably moved by said driver and each having a gate on its periphery; an opening lever having a fence which rides against the periphery of said wheels and which draws said bolt when said fence aligns with all said gates; said driver making audible contact with said lever as the dial is rotated past a detectable contact point; said decoder apparatus comprising a frame which is securable in a fixed position relative to said lock; dial gripper means rotatably journalled in said frame and fittable on said dial for rotating the same; servo motor means having a stator mounted onto said frame and a rotor coupled to said dial gripper means; a rotary encoder coupled to said servo motor to indicate the position of the dial for all rotary positions thereof to within an accuracy of a fractional part of the span between successive integers on the dial, the rotary encoder providing at least a position feedback output indicting the rotary position of the dial; sound transducer means mountable in audible contact with said lock for providing an indication when said contact point is reached; and suitable programed processor and control circuit means having inputs to receive said position feedback output and said indication from said audible transducer means, a motor drive output for rotating the servo motor rotor and said dial to positions chosen by the processor and control circuit means, and storage means for recording the dial position at which the contact point is reached for each wheel of the lock to an accuracy of said fractional part of said span between integers for a plurality of starting positions around the dial; the processor and control circuit means being programmable to operate the servo motor and decode the opening combination based on a manipulation algorithm.

2. Safe lock decoder apparatus according to claim 1 wherein said encoder provides a velocity output, and said processor and control circuit means includes input means to receive said velocity output, and means to control the rotation speed of said servo motor so that aid dial can be rotated at a relatively high speed until near the desired position and then within a predetermined fraction of a rotation of the desired position said dial is automatically slowed to a relatively low speed until the desired position is reached.

3. Safe lock decoder apparatus according to claim 1 wherein said dial gripper means includes a molded cup of synthetic resin material having a receptacle which fits a hub of said dial.

4. Safe lock decoder apparatus according to claim 1 wherein said processor and control circuit means includes means to disregard said sound transducer means except when said dial is rotated in the vicinity of said contact point.

5. Safe lock decoder apparatus for finding the opening combination for a combination lock of the type that includes a rotatable dial containing a predetermined number of equally spaced integers; a driver that is rotatable with said dial; a locking bolt; a plurality of wheels rotatably moved by said driver and each having a gate on its periphery; an opening lever having a fence which rides against the periphery of said wheels and which draws said bolt when said fence aligns with all said gates; said driver making audible contact with said lever as the dial is rotated past a detectable contact point; said decoder apparatus comprising a frame which is securable in a fixed position relative to said lock; dial gripper means rotatably journalled in said frame and fittable on said dial for rotating the same; servo motor means having a stator mounted onto said frame and a rotor coupled to said dial gripper means; a rotary encoder coupled to said servo motor to indicate the position of the dial to within an accuracy of a fractional part of the span between successive integers on the dial, the rotary encoder providing at least a position feedback output indicating the rotary position of the dial; wherein said encoder is a two-phase rotary encoder having a resolution of substantially 1000 parts per rotation; sound transducer means mountable in audible contact with said lock for providing an indication when said contact point is reached; and suitable programmed processor and control circuit means having inputs to receive said position feedback output and said indication from said audible transducer means, a motor drive output for rotating the servo motor rotor and said dial to positions chosen by the processor and control circuit means, and storage means for recording the dial position at which the contact point is reached for each wheel of the lock for a plurality of starting positions around the dial; the processor and control circuit means being programmable to operate the servo motor and decode the opening combination based on a manipulation algorithm.

6. Safe lock decoder apparatus for finding the opening combination for a combination lock of the type that includes a rotatable dial containing a predetermined number of equally spaced integers; a driver that is rotatable with said dial; a locking bolt; a plurality of wheels rotatably moved by said driver and each having a gate on its periphery; an opening lever having a fence which rides against the periphery of said wheels and which draws said bolt when said fence aligns with all said gates; said driver making audible contact with said lever as the dial is rotated pas a detectable contact point; said decoder apparatus comprising a frame which is securable in a fixed position relative to said lock; dial gripper means rotatably journalled in said frame and fittable on said dial for rotating the same; servo motor means having a stator mounted onto said frame and a rotor coupled to said dial gripper means; a rotary encoder coupled to said servo motor to indicate the position of the dial to within an accuracy of a fractional part of the span between successive integers on the dial, the rotary encoder providing at least a position feedback output indicating the rotary position of the dial; sound transducer means mountable in audible contact with said lock for providing an indication when said contact point is reached; suitably programed processor and control circuit means having inputs to receive said position feedback output and said indication from said audible transducer means, a motor drive output for rotating the servo motor rotor and said dial to positions chosen by the processor and control circuit means, and storage means for recording the dial position at which the contact point is reached for each wheel of the lock for a plurality of starting positions around the dial; the processor and control circuit means being programmable to operate the servo motor and decode the opening combination based on a manipulation algorithm; a second motor and means rotatable thereby to actuate a key on said lock; and a command channel from said processor and control circuit means to said second motor for actuating the same.

7. Safe lock decoder apparatus according to claim 6 wherein said second motor is carried within said dial gripper means and said key actuating means actuates a butterfly on said dial.

8. Safe lock decoder apparatus for finding the opening combination for a combination lock of the type that includes a rotatable dial containing a predetermined number of equally spaced integers; a driver that is rotatable with said dial; a locking bolt; a plurality of wheels rotatably moved by said driver and each having a gate on its periphery; an opening lever having a fence which rides against the periphery of said wheels and which draws said bolt when said fence aligns with all said gates; said decoder apparatus comprising a frame which is securable in a fixed position relative to said lock; a dial gripper rotatably journalled in said frame and fittable on said dial for rotating the same; servo motor means having a stator mounted onto said frame and a rotor coupled to said dial gripper; a rotary encoder coupled to said servo motor to indicate the position of the dial to within an accuracy of a fractional part of the span between successive integers on the dial, the rotary encoder providing at least a position feedback output indicting the rotary position of the dial; and suitable programed processor and control circuit means having an input to receive said position feedback output and a motor drive output for rotating the dial to a sequence of positions chosen by the processor and control circuit means; wherein said servo motor is a dc motor and said processor and control circuit means includes means for rotating the motor and said dial at relatively high speed until the dial is near one of said chosen positions, then automatically reducing the rotation speed to a relatively low speed within a predetermined fraction of a dial rotation from the chose position until the chosen position is reached.

9. Safe lock decoder apparatus for finding the opening combination for a combination lock of the type that includes a rotatable dial containing a predetermined number of equally spaced integers; a driver that is rotatable with said dial; a locking bolt; a plurality of wheels rotatably moved by said driver and each having a gate on its periphery; an opening lever having a fence which rides against the periphery of said wheels and which draws said bolt when said fence aligns with all said gates; said decoder apparatus comprising a frame which is securable in a fixed position relative to said lock; a dial gripper rotatably journalled in said frame and fittable on said dial for rotating the same, wherein said gripper is in the form of a molded cup of synthetic resin material having a generally cylindrical receptacle which fits a hub of said dial; servo motor means having a stator mounted onto said frame and a rotor coupled to said dial gripper; a rotary encoder coupled to said servo motor to indicate the position of the dial to within an accuracy of a fractional part of the span between successive integers on the dial, the rotary encoder providing at least a position feedback output indicating the rotary position of the dial; and suitably programed processor and control circuit means having an input to receive said position feedback output and a motor drive output for rotating the dial to a sequence of positions chosen by the processor circuit means; wherein said servo motor is a dc motor and said motor and said dial at relatively high speed until the dial is near one of said chosen positions, then at a relatively low speed until the chosen position is reached.

* * * * *